US009022521B2

(12) United States Patent
Sasaki et al.

(10) Patent No.: US 9,022,521 B2
(45) Date of Patent: May 5, 2015

(54) DROPLET DISCHARGE HEAD, AND IMAGE FORMING APPARATUS

(71) Applicants: Takafumi Sasaki, Kanagawa (JP); Yukitoshi Tajima, Kanagawa (JP)

(72) Inventors: Takafumi Sasaki, Kanagawa (JP); Yukitoshi Tajima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/010,806

(22) Filed: Aug. 27, 2013

(65) Prior Publication Data

US 2014/0078221 A1 Mar. 20, 2014

(30) Foreign Application Priority Data

Sep. 18, 2012 (JP) ..... 2012-204877
Feb. 7, 2013 (JP) ..... 2013-022038

(51) Int. Cl.
*B41J 2/015* (2006.01)
*B41J 2/14* (2006.01)
*B41J 2/16* (2006.01)

(52) U.S. Cl.
CPC ..... *B41J 2/1433* (2013.01); *B41J 2/14233* (2013.01); *B41J 2/161* (2013.01); *B41J 2/1623* (2013.01); *B41J 2002/14362* (2013.01); *B41J 2202/11* (2013.01)

(58) Field of Classification Search
None
See application file for complete search history.

(56) References Cited

U.S. PATENT DOCUMENTS

| | | | | |
|---|---|---|---|---|
| 5,943,079 | A | 8/1999 | Yoshida | |
| 8,033,657 | B2 | 10/2011 | Sasaki | |
| 8,042,911 | B2 | 10/2011 | Sasaki | |
| 8,197,048 | B2 | 6/2012 | Yamanaka et al. | |
| 8,414,097 | B2 | 4/2013 | Sasaki | |
| 2001/0043248 | A1 * | 11/2001 | Ikegami et al. | 347/20 |
| 2007/0008388 | A1 | 1/2007 | Yamaguchi et al. | |
| 2009/0009569 | A1 * | 1/2009 | Sasaki | 347/85 |
| 2013/0070018 | A1 | 3/2013 | Sasaki | |
| 2013/0176363 | A1 | 7/2013 | Sasaki | |

FOREIGN PATENT DOCUMENTS

| | | |
|---|---|---|
| JP | 2004-351811 | 12/2004 |
| JP | 3680394 | 8/2005 |
| JP | 4453965 | 4/2010 |

OTHER PUBLICATIONS

U.S. Appl. No. 13/949,589, filed Jul. 24, 2013.

* cited by examiner

*Primary Examiner* — Matthew Luu
*Assistant Examiner* — Erica Lin
(74) *Attorney, Agent, or Firm* — Cooper & Dunham LLP

(57) ABSTRACT

Disclosed is a droplet discharge head including a nozzle substrate including a nozzle, an individual liquid chamber substrate including an individual liquid chamber, and a common liquid chamber substrate including a common liquid chamber, wherein the substrates are laminated, wherein a portion of a top surface of the common liquid chamber is flexible, wherein the top surface of the common liquid chamber is disposed at a side opposite to another side at which the nozzle plate is disposed, wherein the common liquid chamber has a shape such that one portion of the common liquid chamber is narrowed in a direction in which the substrates are laminated, wherein a height of a wall of the common liquid chamber in the direction in which the substrates are laminated is constant, and wherein the wall is substantially perpendicular to the top surface.

13 Claims, 23 Drawing Sheets

DROPLET DISCHARGE HEAD, AND IMAGE FORMING APPARATUS

BACKGROUND OF THE INVENTION

1. Field of the Invention

The present invention relates to a droplet discharge head and an image forming apparatus.

2. Description of the Related Art

An inkjet recording apparatus including a liquid droplet discharge device has been known as an image forming apparatus. Here, in the liquid droplet discharge device, a droplet discharge head is used as a recording head. Examples of the image forming apparatus include a printer, a facsimile machine, a copier, and a combined machine thereof.

The inkjet recording apparatus performs recording by discharging a recording liquid (ink) onto a paper sheet. Here, the sheet is not limited to the paper sheet. The sheet includes, for example, a transparency (an OHP sheet). The sheet means something to which a recording liquid, such as ink, or other liquids can be adhered. The sheet also referred to as a "medium to be recorded," a "recording medium," or a "recording paper." The inkjet recording apparatus can record a high definition color image at high speed. Now, the inkjet recording apparatuses are used for industrial systems.

Such a droplet discharge head includes, in general, a plurality of nozzle sequences. The droplet discharge head also includes a plurality of individual liquid chambers. The individual liquid chambers are in communication with the corresponding nozzle sequences. In general, the individual liquid chambers are in communication with a common recording liquid reservoir (which is referred to as a "common liquid chamber," hereinafter) having relatively large capacity.

Any image can be formed on demand by discharging the recording liquid onto the recording medium by applying energy to the selected individual liquid chambers. Examples of an element for applying the energy include a piezoelectric element and a heater chip.

Recently, demands for high quality images and high speed printing are increasing. To address the demand for high quality images, in the droplet discharge head, a number of nozzles and density of the nozzles are increasing. Accordingly, spacing among the individual liquid chambers is getting smaller. A frequency of applying the energy is increasing. Additionally, to address the demand for high speed printing, the recording head has been elongated. Recently, a so-called "line printer" is available. The line printer can cover the entire portion in the width direction of the recording medium.

As described above, when the energy is applied to the individual liquid chamber, pressure change is caused in the recording liquid in the individual liquid chamber. The pressure change is transmitted to the common liquid chamber, which is connected to the plurality of liquid chambers so as to supply the recording liquid to the liquid chambers. Accordingly, such pressure changes affect not only the recording liquid in the target individual liquid chamber, but also the recording liquid in the neighboring individual liquid chamber. This phenomenon is referred to as "mutual interference." The mutual interference may cause unintentional discharging of liquid droplets or an unstable discharging state. Consequently, the mutual interference may interfere with forming a high quality image.

To suppress this pressure change, a configuration has been considered which includes a damper in the common liquid chamber.

For example, Patent Document 1 (Japanese Patent No. 3680394) discloses a configuration in which an elastic portion is formed on one of wall surfaces of a common liquid chamber, in order to improve a damping effect. In this example, an ink manifold faces a damper chamber through a flexible member. The damper chamber is in communication with external air through an air vent.

Unfortunately, the configuration disclosed in Patent Document 1 is disadvantageous for supplying ink to the common chamber. The ink manifold has a substantially cubic shape. At an end portion of the flow, the ink tends to stagnate. Consequently, at this portion, air bubbles, which are mixed with the ink in an ink flow channel, tend to stagnate. The air bubbles flow into a cavity by a certain cause. The air bubbles in the cavity may absorb the generated pressure. Thus, it is possible that the air bubbles prevent liquid droplets from being normally discharged.

Patent Document 2 (Japanese Patent No. 4453965) discloses a structure such that a common liquid chamber is narrowed at an end portion in a direction in which the liquid droplets are discharged, and a damper is disposed on a surface facing the narrowed surface. Here, the damper is formed of a thin film. In this configuration, flow speed of ink increases at the end portion of the common liquid chamber. Accordingly, it becomes easier to supply the ink.

In this example, the damper is formed of an extremely thin metal film or resin film. When this film is disposed at a side of a nozzle surface, it is possible that the thin film is damaged from outside by an external force which is caused, for example, by paper jamming. In order to avoid this, another member, such as a nozzle cover, may be required. Thus, it is possible that the cost is increased.

Further, Patent Document 3 (Japanese Unexamined Patent Publication No. 2004-351811) discloses a configuration, with which an attempt is made to obtain a damping effect by including an elastic body, such as a rubber or a flexible material containing air bubbles, in a portion of a wall surface of a common liquid chamber. Further, in this example, since the common liquid chamber is narrowed in a depth direction at an end portion, ability to discharge air bubbles can be improved.

However, this configuration is achieved by pressing the elastic body (e.g., a rubber) into a depression which is formed in advance in a relatively hard resin (e.g., a thermosetting epoxy resin). In order to achieve such a configuration, an additional pressing process is required. Furthermore, it is possible that the elastic body is removed or missed. Accordingly, such a configuration may adversely affect the discharging reliability. Further, in the configuration, the resin is not so flexible. In order to achieve a necessary and sufficient damping characteristic, for the elastic body, a material is required which has a high damping coefficient and resistance against a liquid to be utilized. Consequently, the choices for the material are limited. This leads to an increase in the cost.

There is a need for a low cost droplet discharge head which can be easily assembled, while improving ease of charging a common liquid chamber with a liquid and an air-bubble discharging property of the common liquid chamber.

SUMMARY OF THE INVENTION

According to an aspect of the present invention, there is provided a droplet discharge head including a nozzle substrate including a nozzle configured to discharge liquid droplets; an individual liquid chamber substrate in which an individual liquid chamber is formed, wherein the individual liquid chamber is in communication with the nozzle; and a common liquid chamber substrate in which a common liquid chamber is formed, wherein the common liquid chamber is in communication with the individual liquid chamber. The nozzle substrate, the individual liquid chamber substrate, and the common liquid chamber substrate are laminated. At least a portion, which is a flexible portion, of a top surface of the common liquid chamber is flexible, wherein the top surface of the common liquid chamber is disposed at a side which is opposite to another side at which the nozzle plate is disposed. The common liquid chamber has a shape such that at least one portion of the common liquid chamber is narrowed in a direction in which the nozzle substrate, the individual liquid chamber substrate, and the common liquid chamber substrate are laminated. A height of a wall of the common liquid chamber in the direction in which the nozzle substrate, the individual liquid chamber substrate, and the common liquid chamber substrate are laminated is constant, wherein the wall is substantially perpendicular to the top surface.

According to another aspect of the present invention, there is provided an image forming apparatus including a droplet discharge head, wherein the droplet discharge head includes a nozzle substrate including a nozzle configured to discharge liquid droplets; an individual liquid chamber substrate in which an individual liquid chamber is formed, wherein the individual liquid chamber is in communication with the nozzle; and a common liquid chamber substrate in which a common liquid chamber is formed, wherein the common liquid chamber is in communication with the individual liquid chamber. The nozzle substrate, the individual liquid chamber substrate, and the common liquid chamber substrate are laminated. At least a portion of a top surface of the common liquid chamber is flexible, wherein the top surface of the common liquid chamber is disposed at a side which is opposite to another side at which the nozzle plate is disposed. The common liquid chamber has a shape such that at least one portion of the common liquid chamber is narrowed in a direction in which the nozzle substrate, the individual liquid chamber substrate, and the common liquid chamber substrate are laminated. A height of a wall of the common liquid chamber in the direction in which the nozzle substrate, the individual liquid chamber substrate, and the common liquid chamber substrate are laminated is constant, wherein the wall is substantially perpendicular to the top surface.

According to an embodiment of the present invention, there can be provided a low cost droplet discharge head which can be easily assembled, while improving ease of charging a common liquid chamber with a liquid and an air-bubble discharging property of the common liquid chamber.

Other objects, features and advantages of the present invention will become more apparent from the following detailed description when read in conjunction with the accompanying drawings.

DETAILED DESCRIPTION OF THE PREFERRED EMBODIMENTS

Hereinafter, an embodiment of the present invention is explained by using the accompanying drawings. However, the present invention is not limited to the embodiment of the present invention.

An Example

There is explained a configuration example of a droplet discharge head according to the embodiment of the present invention.

The droplet discharge head according to the embodiment includes a nozzle substrate in which a nozzle for discharging liquid droplets is formed; an individual liquid chamber substrate in which an individual liquid chamber is formed, wherein the individual liquid chamber is in communication with the nozzle; and a common liquid chamber substrate in which a common liquid chamber is formed, wherein the common liquid chamber is in communication with the individual liquid chamber. Here, the nozzle substrate, the individual liquid chamber substrate, and the common liquid chamber substrate are laminated. At least a portion of a top surface of the common liquid chamber has flexibility, and the top surface of the common liquid chamber is disposed at a side opposite to a side at which the nozzle substrate is disposed. The common liquid chamber has a shape such that at least one portion of the common liquid chamber is narrowed in a direction in which the nozzle substrate, the individual liquid chamber substrate, and the common liquid chamber substrate are laminated. Heights of walls of the common liquid chamber in a direction in which the nozzle substrate, the individual liquid chamber substrate, and the common liquid chamber substrate are laminated are constant. Here, the walls are perpendicularly disposed with respect to the top surface.

Hereinafter, a specific configuration of the droplet discharge head is explained by referring the accompanying drawings.

Figure 1:
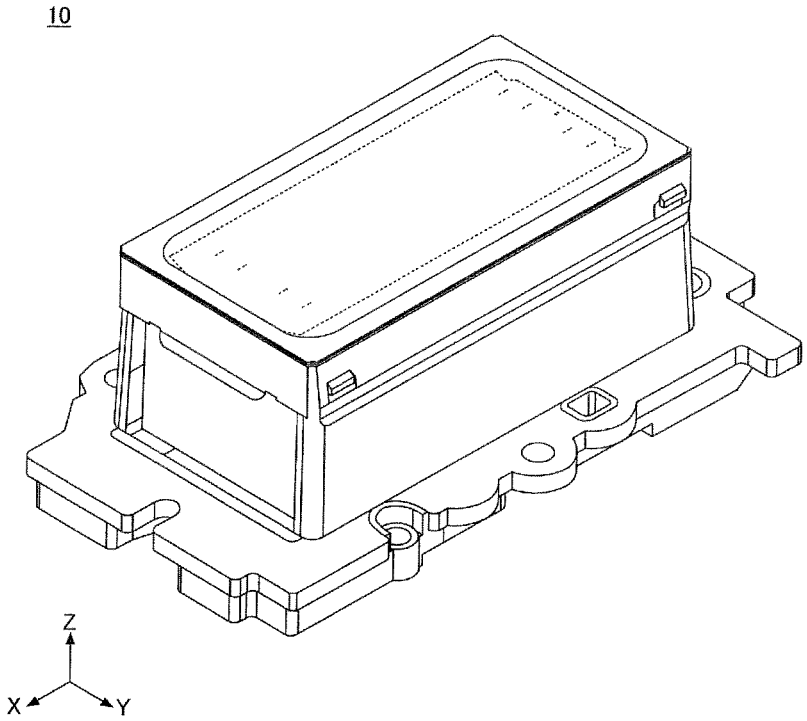
FIG. 1 is a general view of a droplet discharge head according to an example.

FIG. 1 is a general view of the droplet discharge head according to the embodiment. In FIG. 1, the droplet discharge head is viewed from a side of a surface in which nozzles are formed. In a top surface portion in FIG. 1, a plurality of nozzle holes (not shown) are formed.

Figure 2:
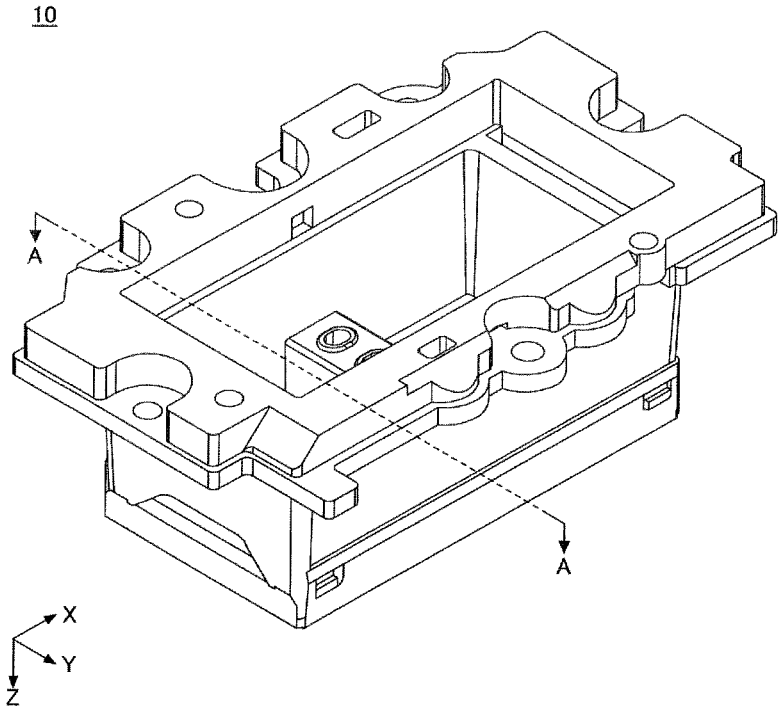
FIG. 2 is a general view of the droplet discharge head according to the example.
Figure 3:
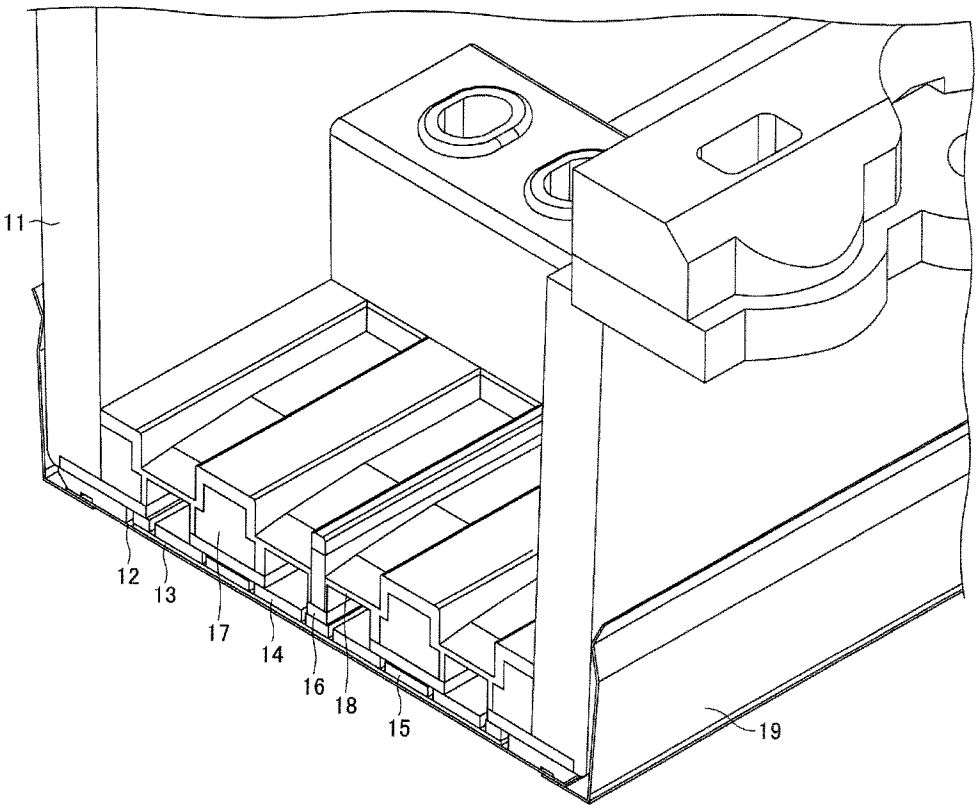
FIG. 3 is a lateral cross-sectional view of the droplet discharge head according to the example.
Figure 4:
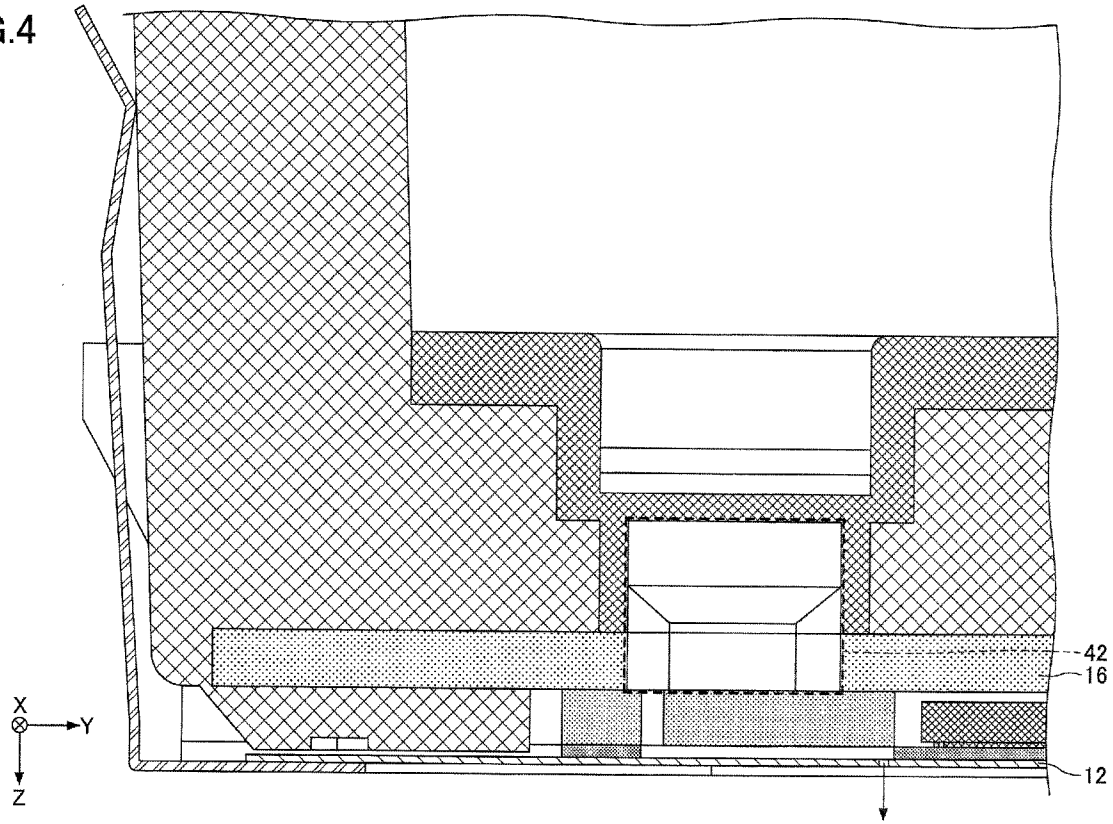
FIG. 4 is a magnified view of the lateral cross-section of the droplet discharge head according to the example.

FIG. 2 is another general view of the droplet discharge head. In FIG. 2, the droplet discharge head is viewed from the other side of the surface in which the nozzles are formed. FIG. 3 is a cross-sectional view showing an A-A cross-sectional view of the droplet discharge head of FIG. 2. Namely, FIG. 3 is a lateral cross-sectional view of the droplet discharge head. FIG. 4 is a magnified view of the lateral cross-section of the droplet discharge head, which is shown in FIG. 3. In FIG. 4, the vicinity of a common liquid chamber, which is described later, is magnified.

As shown in FIGS. 3 and 4, the droplet discharge head 10 has a configuration such that substrates are laminated and disposed in a housing 11.

As shown in FIGS. 3 and 4, in the droplet discharge head 10, a nozzle substrate (nozzle plate) 12 and an individual liquid chamber substrate (actuator plate) 13 are laminated in this order from the side of the nozzle. Further, above the individual liquid chamber substrate 13, a common liquid chamber substrate is laminated through a sub-frame 14. The common liquid chamber substrate forms the common liquid chamber.

In the example shown in FIG. 3, in the nozzle substrate (nozzle plate) 12, four lines of pluralities nozzle holes are punched. One line includes 320 nozzle holes. Thus, the four lines include 1280 nozzle holes. Here, the number of the nozzle holes is not limited to the above-described example. The number of the nozzle holes may be selected based on required performance of the droplet discharge head.

A material of the nozzle substrate 12 is not particularly limited. The material of the nozzle substrate 12 may be suitably selected based on required durability and rigidity. For example, the nozzle substrate 12 may be formed of a metal. The nozzle substrate can be formed of stainless steel (Steel Use Stainless (SUS)). When the nozzle substrate 12 is formed of the stainless steel, the nozzle holes can be formed by press working.

In the individual liquid chamber substrate (actuator plate) 13, individual liquid chambers (pressure chambers) are formed. The individual liquid chambers correspond to the nozzle holes which are formed in the nozzle substrate 12. For example, the individual liquid chambers may be formed by etching processing.

Further, in the individual liquid chamber substrate (actuator plate) 13, an oscillation plate can be formed. The oscillation plate can be formed of an Si compound. The oscillation plate may be laminated by a CVD method (producing method), for example. The thickness of the oscillation plate is not particularly limited. However, the thickness can be approximately 2 μm, for example.

Further, on the oscillation plate, electrodes and a piezoelectric element can be formed by a photolithography method. Here, the electrodes and the piezoelectric element are laminated, while corresponding to the nozzle and the individual liquid chamber. A driving signal is transmitted to the head through electric wiring (not shown). A driver IC 15 selects a signal, and the selected driving signal is applied to the piezoelectric element. By switching the signal by the driver IC 15, any piezoelectric element can be deformed. In accordance with the deformation of the piezoelectric element, the oscillation plate which is integrally formed with the piezoelectric element is displaced, and the volume of the individual liquid chamber is changed. Then, pressure is applied to the liquid inside the individual liquid chamber, and thereby the liquid droplets are discharged from the opening of the nozzle.

In the droplet discharge head according to the embodiment, the nozzles, the individual liquid chambers, and the piezoelectric elements are arranged at a density of 600 dpi. Each of the four lines includes the nozzles, the individual liquid chambers, and the piezoelectric elements, and the four lines are arranged in parallel.

The sub-frame 14 is a support of the actuator plate 13. The sub-frame 14 can be formed by applying etching processing to a Si substrate, for example. The thickness of the sub-frame 14 is not particularly limited. However, the sub-frame 14 can be a plate-like member having a thickness of approximately 400 μm, for example. In the sub-frame 14, an opening for accommodating the driver IC 15 may be formed. In addition, an ink supply port may be formed in the sub-frame 14.

A backing plate 16, a backing plate 17, and the housing 11 can be an integrally-molded product, which is integrally molded by insert molding.

In the droplet discharge head 10 according to the embodiment, it is preferable that, among the walls of the common liquid chamber, the member which forms a flexible portion and at least one portion of the members which form the other portions of the walls be integrally formed.

With such a configuration, many components can be joined without introducing an adhesion layer. Thus, production requirements can be reduced and cost reduction can be achieved.

For example, it is preferable that a portion which directly contacts the member which forms the flexible portion be integrally formed with the member which forms the flexible portion. Further, as described above, it is preferable that the common liquid chamber (ink reservoir) 42 is formed by two-color molding a damper layer 18 with respect to the integrally-molded product in which the backing plate 16, the backing plate 17, and the housing 11 are integrally molded, as described above.

Further, it is preferable that the above-described flexible portion, namely, the damper layer 18 according to the embodiment, be formed by elastomer injection molding.

With such a configuration, a material having a low Young's modulus can be used as the damper layer 18 of the common liquid chamber 42. In this manner, a higher damping effect can be achieved.

In the embodiment, the example of the droplet discharge head 10 is considered, in which the four sequences of common liquid chambers 42 are formed so as to correspond to the four colors of ink. However, the droplet discharge head 10 is not limited to this example.

The material of the backing plate 16 and the material of the backing plate 17 are not particularly limited. The materials can be selected depending on required durability and rigidity. For example, a metal can be preferably used for the backing plate 16, which contacts the sub-frame 14. Specifically, it is preferable to use, for example, stainless steel (Steel Use Stainless (SUS)) for the backing plate 16. Further, a resin can be preferably used as a material of the backing plate 17, which is disposed on a top surface of the backing plate 16. Specifically, for example, a polyphenylene sulfide resin (which is also denoted as PPS, hereinafter) can be preferably utilized.

By providing the damper layer 18, at least a portion of the wall of the common liquid substrate 42 can be flexible, as described above. Here, the wall forms the top surface at the side opposite to the side where the nozzle substrate 12 is formed. By including such a configuration, a damping function can be provided.

The material of the damper layer 18 is not particularly limited. For example, as described above, the damper layer 18 may be formed of an elastomer, which is a polymer material. Here, the elastomer demonstrates rubber elasticity at around room temperature.

In this manner, by providing the damper layer 18, compliance of the material of the damper layer 18, for example, compliance of a resin structure, can absorb pressure variation in the common liquid chamber, which is caused by the driving of the piezoelectric element. For the case where the damper layer 18 is formed of the elastomer, it is preferable that the elastomer be a member having resistance against the recording liquid to be utilized, such as ink, and that the material of the elastmer be a material having a small Young's modulus, so as to ensure large compliance.

Further, the thickness of the damper layer 18 is not particularly limited. The thickness of the damper layer 18 can be selected depending on required durability and flexibility. For example, the thickness of the damper layer 18 can be within a range from 100 μm to 300 μm.

Further, a layer for preventing moisture transmission may be attached to the surface of the damper layer 18. Specifically, for example, a metal layer (e.g., a layer of Ti or Nb) may be formed on the surface of the damper layer 18 by sputtering, or a layer of $SiO_2$ or the like may be vapor-deposited on the surface of the damper layer 18. In this manner, by providing the layer for preventing moisture transmission on the surface of the damper layer 18, viscosity of the ink can be prevented from being increased by the moisture transmission. The layer for preventing moisture transmission may be attached to both sides of the damper layer 18. Alternatively, the layer for preventing moisture transmission may be attached to one side of the damper layer 18.

As described above, the droplet discharge head 10 can be formed by laminating and adhesively bonding the sub-frame 14, the individual liquid chamber substrate (actuator plate) 13, and the nozzle substrate 12 to the product, in which the damper layer 18 is two-color molded with the integrally-molded product. Here, in the integrally-molded product, the housing 11, the backing plate 16, and the backing plate 17 are integrally molded.

Further, as shown in FIG. 3, a nozzle cover 19 may be provided to the outer most surface portion of the droplet discharge head 10.

Figure 5:
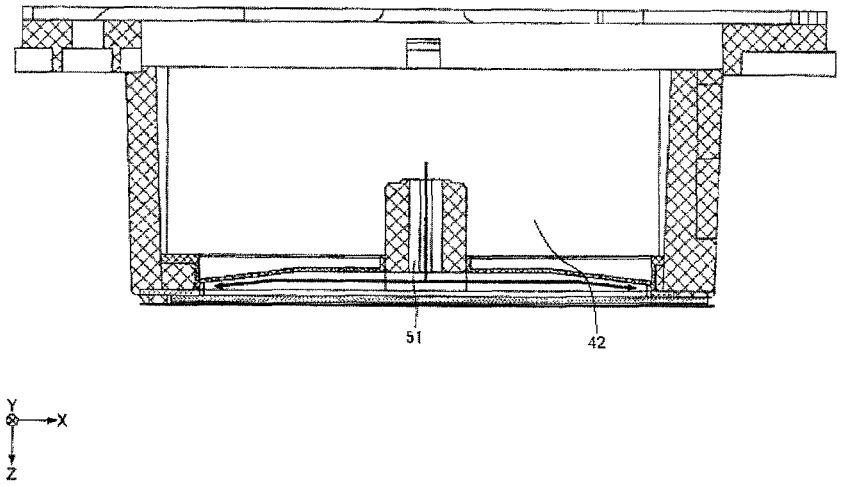
FIG. 5 is a longitudinal cross-sectional view of the droplet discharge head according to the example.

FIG. 5 shows an XZ-cross section (along the longitudinal direction) of the common liquid chamber 42 (which is shown in FIGS. 3 and 4) at a center portion in the Y-axis direction (along the lateral direction).

As shown in FIG. 5, the common liquid chamber 42 includes an ink supply port 51. The ink supply port 51 is disposed at center of the common liquid chamber 42. The common liquid chamber 42 has a shape, which is extended in the longitudinal direction. The ink supplied from an ink tank (not shown) flows from the ink supply port 51 to the corresponding nozzles through the common liquid chamber 42. The arrows in FIG. 5 indicate the directions along which the ink supplied from the ink supply port 51 flows into the common liquid chamber 42. As shown in FIG. 5, at end portions (end portions in the longitudinal direction) of the common liquid chamber 42, the common liquid chamber 42 is narrowed in the height direction, namely, in the direction in which the nozzle substrate 12, the individual liquid chamber substrate 13, and the common liquid chamber substrate are laminated. In this manner, the flow speed of the ink at the end portions of the common liquid chamber 42 can be increased, and thereby ease of charging the common liquid chamber 42 with the ink and the air-bubble discharging property are improved.

When the common liquid chamber 42 has the structure such that the end portions in the longitudinal direction of the common liquid chamber 42 are narrowed, if the backing plate 17, which is neighboring the damper layer 18, is narrowed along the damper layer 18, a portion may be formed which cannot be pressed during adhesive bonding. Hereinafter, this point is explained.

Figure 6:
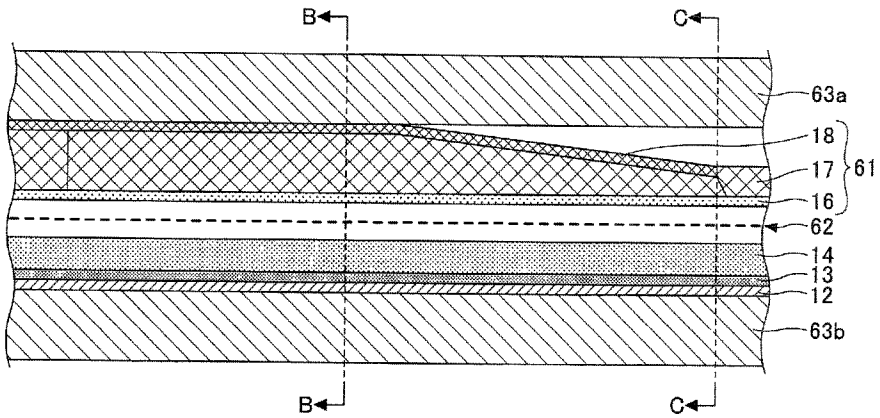
FIG. 6 is a schematic longitudinal cross-sectional view illustrating a problem during assembling a droplet discharge head.

FIG. 6 shows a schematic cross-section of the droplet discharge head 10 in the longitudinal direction (schematic longitudinal cross-sectional view of the droplet discharge head 10). FIG. 6 shows a state where the sub-frame 14, the individual liquid chamber substrate (actuator plate) 13, and the nozzle substrate 12 are laminated and adhesively bonded to the common liquid chamber substrate 61, which includes the backing plate 16, the backing plate 17, and the damper layer 18. FIG. 6 shows only a half-portion of the cross-section of the droplet discharge head 10 in the longitudinal direction.

Figure 7A:
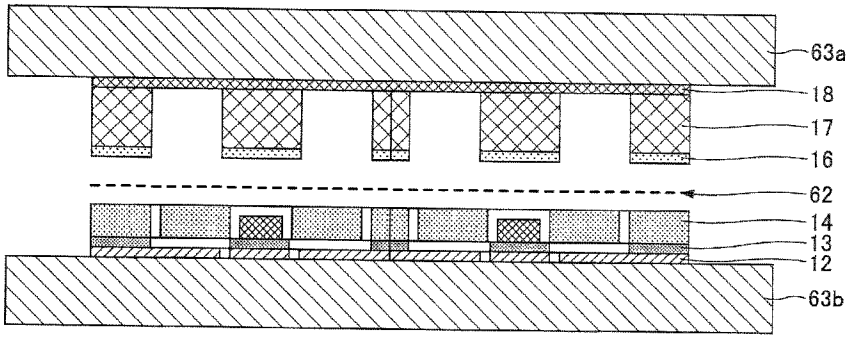
FIGS. 7A and 7B are schematic lateral cross-sectional views illustrating the problem during assembling the droplet discharge head.
Figure 7B:
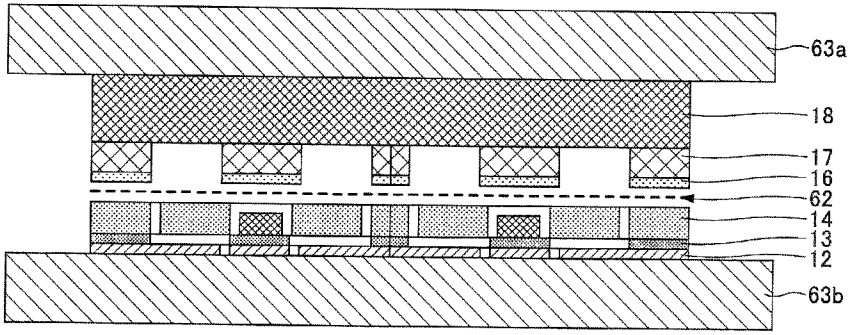

FIG. 7A shows a schematic cross-sectional view of the droplet discharge head 10 at the B-B line in FIG. 6. FIG. 7B shows a schematic cross-sectional view of the droplet discharge head 10 at the C-C line in FIG. 6.

As shown in FIGS. 6, 7A, and 7B, for adhesively bonding the common liquid chamber substrate 61 with a bonding interface 62, which is shown by the dotted line in FIGS. 6, 7A, and 7B, pressure is applied to the common liquid chamber substrate 61 from the upper surface and the lower surface by using jigs 63*a* and 63*b*.

However, at the narrowed portion (the right portion in FIG. 6), the jigs 63*a* and 63*b* may not contact the component (such as the backing plate 17). Consequently, the pressure may not be applied to the narrowed portion. Since the narrowed portion of the common liquid chamber substrate 61 may be bonded only at the boundary portion (a portion between the narrowed portion and the portion other than the narrowed portion), it is possible that the narrowed portion is not bonded, depending on flatness of the component. To avoid this, a large amount of adhesive may be applied. However, in this case, at a portion at which the pressure can be applied, an extra amount of the adhesive may protrude, and the ink flow channels to the individual liquid chambers which are formed in the sub-frame 14 may be clogged. Since a failure such as clogging of the ink flow channels may be caused, it is not preferable to apply a large amount of adhesive. A solution may be considered such that a level difference is provided to the jig 63*a*. However, in general, a flatness tolerance is very severe. Accordingly, in this case, the jig 63*a* may be expensive.

Figure 8:
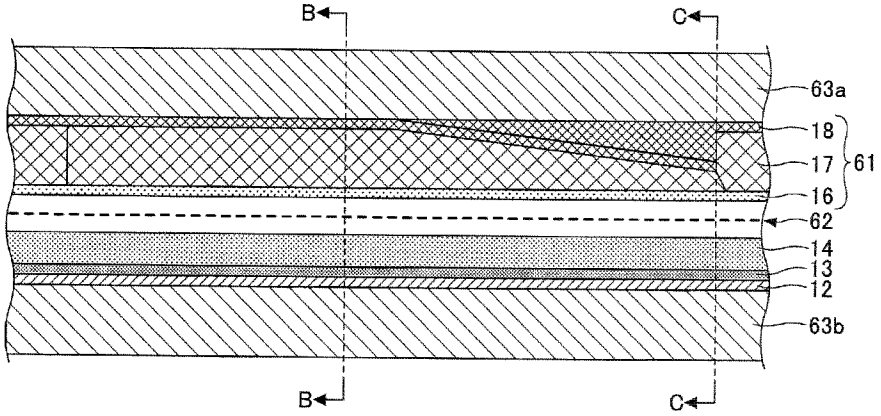
FIG. 8 is a schematic longitudinal cross-sectional view of the droplet discharge head according to the example, wherein the droplet discharge head is being assembled.
Figure 9A:
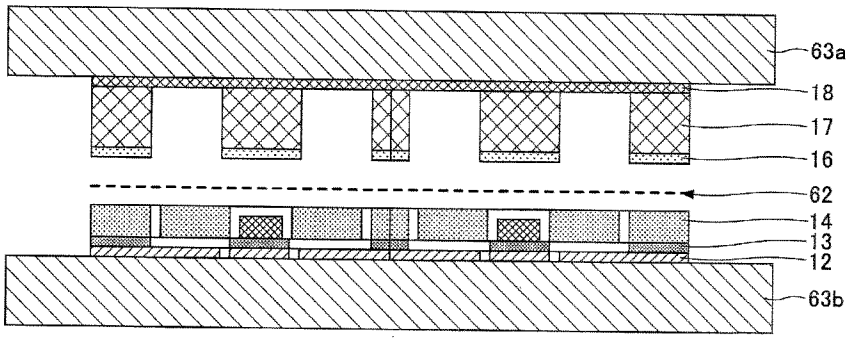
FIGS. 9A and 9B are schematic lateral cross-sectional views of the droplet discharge head according to the example, wherein the droplet discharge head is being assembled.
Figure 9B:
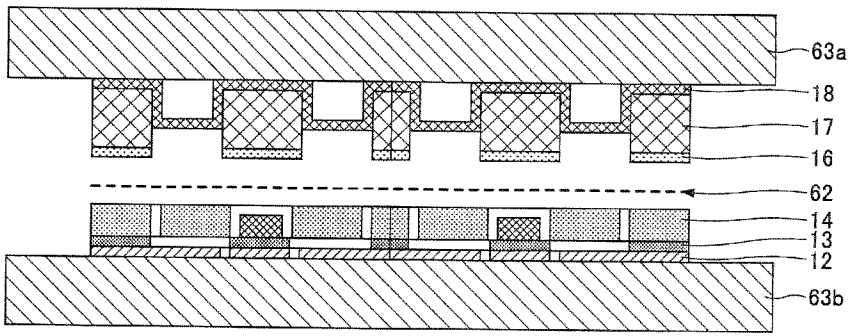

In the droplet discharge head 10 according to the embodiment, as shown in FIGS. 8, 9A, and 9B (which correspond to FIGS. 6, 7A, and 7B, respectively), the height of the walls, which form the common liquid chamber 42 and which are perpendicular to the top surface, is constant along the longitudinal direction of the droplet discharge head 10. Only the damper layer 18 is gradually narrowed. Namely, in FIGS. 8, 9A, and 9B, the total height of the backing plate 16, the backing plate 17, and the damper layer 18 is constant along the longitudinal direction of the droplet discharge head 10.

With such a configuration, pressure from the pressing jigs 63*a* and 63*b* can be directly applied to the corresponding members, even at the narrowed portion.

Consequently, the bonding interface 62 can be pressed, while uniformly applying pressure to each of the substrates included in the droplet discharge head 10 across the whole surface. In this manner, assemblability of the droplet discharge head 10 can be improved. Further, since a yield rate can be increased without using special jigs, the cost reduction can be achieved.

In FIGS. 8, 9A, and 9B, the damper layer 18 is disposed on the top surface of the backing plate 17 in the narrowed portion. However, as described above, it suffices if the total of the height of the backing plate 16, the height of the backing plate 17, and the height of the damper layer 18 is constant along the longitudinal direction of the droplet discharge head 10. For example, the edge portion of the narrowed portion may only include the backing plate 17.

With the droplet discharge head according to the embodiment, ease of charging the common liquid chamber with the ink and the air-bubble discharging property of the common liquid chamber can be improved. At the same time, the assemblability of the droplet discharge head can be improved and the cost reduction can be achieved, without reducing the damping function.

Another Example

Hereinafter, there is explained another example of the droplet discharge head according to the embodiment.

This example of the droplet discharge head is different from the above-described droplet discharge head in a point that the damper layer 18 is formed not only in the top surface, but also in a portion of a wall surface, which is substantially perpendicular to the top surface. Thus, this point is explained. Since other points are the same as those of the above-described droplet discharge head, explanations of the other points are omitted.

Namely, in the droplet discharge head according to this example, in addition to the top surface, at least the portion of the wall surface, which is substantially perpendicular to the top surface, is flexible.

Hereinafter, the droplet discharge head according to this example is explained by referring to FIGS. 10, 11A, and 11B.

Figure 10:
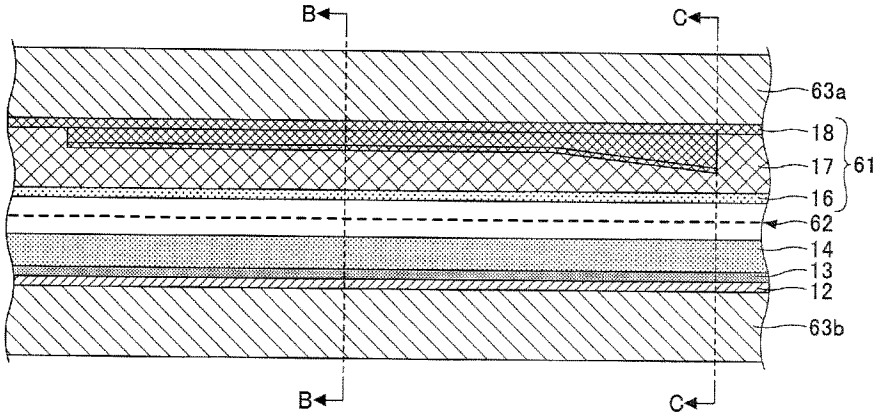
FIG. 10 is a schematic longitudinal cross-sectional view of the droplet discharge head according to another example, wherein the droplet discharge head is being assembled.

FIG. 10 shows a schematic cross-sectional view in the longitudinal direction of the droplet discharge head (schematic longitudinal cross-sectional view of the droplet discharge head). FIG. 10 shows a state where the sub-frame 14, the individual liquid chamber substrate (actuator plate) 13, and the nozzle substrate 12 are laminated and adhesively bonded to the common liquid chamber substrate 61, which includes the backing plate 16, the backing plate 17, and the damper layer 18.

Figure 11A:
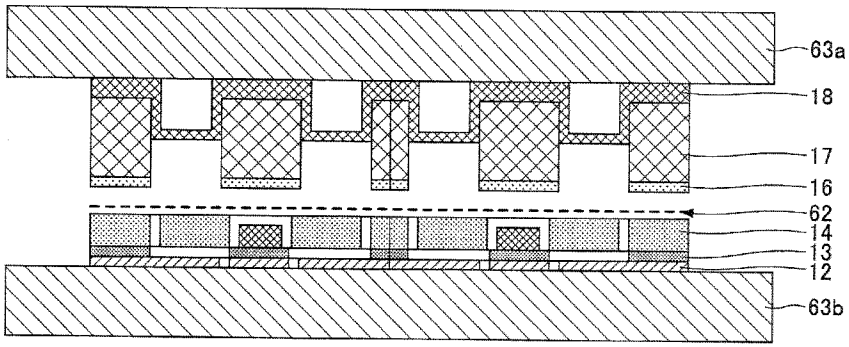
FIGS. 11A and 11B are schematic lateral cross-sectional views of the droplet discharge head according to the other example, wherein the droplet discharge head is being assembled.
Figure 11B:
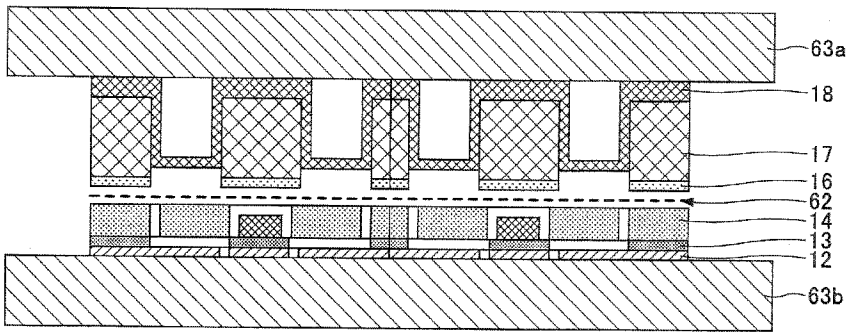

FIG. 11A shows a schematic cross-sectional view of the droplet discharge head at the B-B line in FIG. 10. FIG. 11B shows a schematic cross-sectional view of the droplet discharge head at the C-C line in FIG. 10.

In the droplet discharge head according to this example, as shown in FIG. 11A, the position of the damper plate 18 is lowered by one step relative to the position of the top surface of the backing plate 17 (the surface opposite to the side of the nozzle substrate 12, namely the top surface in FIG. 11A), even at a portion other then the narrowed portion. Further, as shown in FIGS. 11A and 11B, the thickness of the damper layer 18 is not constant. The damper layer 18 can be formed such that the thickness of a portion of the damper layer 18 corresponding to the top surface of the common liquid chamber 42 is small, and the thickness of a portion of the damper layer 18 corresponding to the top surface of the backing plate 17 is slightly large.

With such a configuration of the damper layer 18, elastic compliance of the one wall surface (the top surface) of the common liquid chamber 42 can be enlarged, and the damping effect can further be improved.

Here, since the thickness of the portion of the damper layer 18 corresponding to the top surface of the common liquid chamber 42 is small (e.g., 100 μm-200 μm), if the damper layer 18 is damaged during manufacturing, for example, subsequently the damper layer 18 may be broken, and leakage of the ink may be caused.

As in the case of the droplet discharge head according to this example, by lowering the portion of the damper layer 18 corresponding to the top surface of the common liquid chamber 42 by one step, the damper layer 18 can be prevented from directly contacting the jigs 63*a* and 63*b*, which are used for assembling the droplet discharge head. In this manner, during manufacturing or assembling, the damper layer 18 can be pressed, while preventing the damper layer 18 (which is a thin film portion of the common liquid chamber 42, namely, which is a flexible member) from being damaged.

When an elastomer is used as a material of the damper layer 18, and PPS is used as a material of the backing plate 17, in general, adhesiveness between these materials is weak. However, by providing a step, similar to this example, an adhesion area on the vertical wall surface can be added. Accordingly, adhesive strength can be increased. Thus, the durability of the droplet discharge head can be improved. Further, the yield rate of the droplet discharge head can be increased.

Another Example

Hereinafter, there is explained another example of the droplet discharge head according to the embodiment.

The droplet discharge head according to this example is different from that of the above-described examples in a point that a configuration of the damper layer 18 is different from that of the above-described examples. Accordingly, this point is explained. Since other points are the same as those of the first one of above-described examples, explanations of the other points are omitted.

Namely, in the droplet discharge head according to this example, in addition to the top surface, a portion of the wall surface is flexible. Here the wall surface is substantially perpendicular to the top surface. Specifically, in this example, a range of a flexible member which is formed in the wall surface (which is substantially perpendicular to the top surface) is different from that of the second one of the above-described examples.

Hereinafter, the droplet discharge head according to this example is explained by referring to FIGS. 12, 13A, and 13B.

Figure 12:
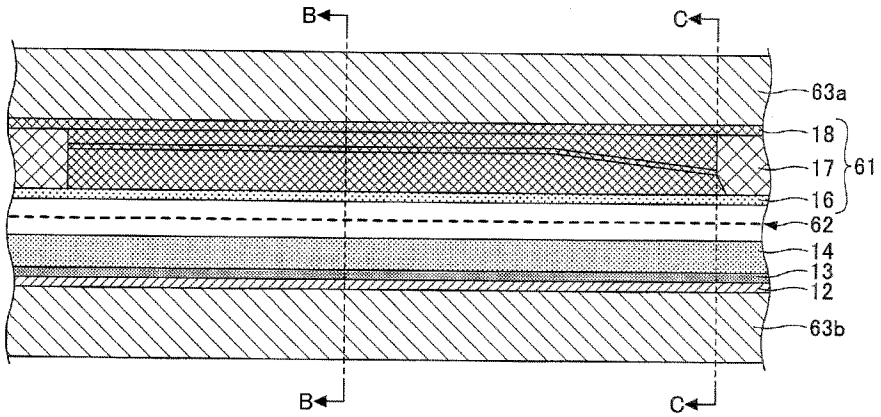
FIG. 12 is a schematic longitudinal cross-sectional view of the droplet discharge head according to another example, wherein the droplet discharge head is being assembled.

FIG. 12 shows a schematic cross-sectional view in the longitudinal direction of the droplet discharge head (schematic longitudinal cross-sectional view of the droplet discharge head). FIG. 12 shows a state where the sub-frame 14, the individual liquid chamber substrate (actuator plate) 13, and the nozzle substrate 12 are laminated and adhesively bonded to the common liquid chamber substrate 61, which includes the backing plate 16, the backing plate 17, and the damper layer 18.

Figure 13A:
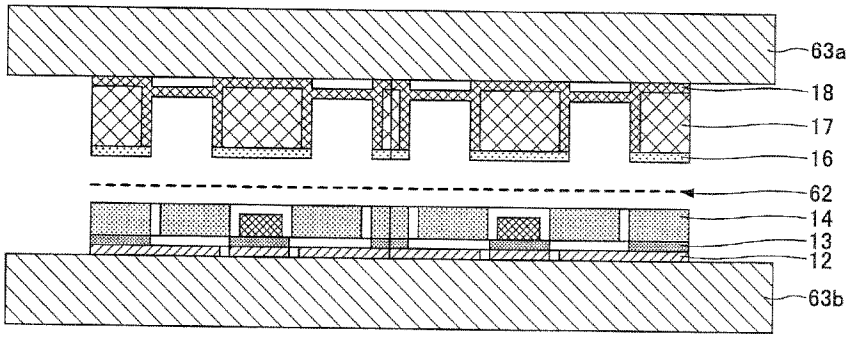
FIGS. 13A and 13B are schematic lateral cross-sectional views of the droplet discharge head according to the other example, wherein the droplet discharge head is being assembled.

FIG. 13A shows a schematic cross-sectional view of the droplet discharge head at the B-B line in FIG. 12. FIG. 13B shows a schematic cross-sectional view of the droplet discharge head at the C-C line in FIG. 12.

In this example, as shown in FIG. 12, the damper layer 18 is formed in a vertical wall surface within the common liquid chamber 42.

Figure 13B:
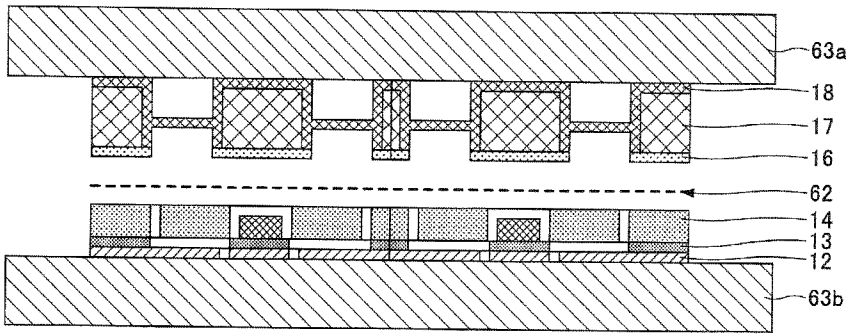

As shown in the cross-sections of FIGS. 13A and 13B, the width of the backing plate 16 is slightly larger than the width of the backing plate 17. This step is provided for molding the backing plate 17, while pressing the backing plate 16 by a metal mold, so as to prevent floating of the backing plate 16 during molding.

If this step remains, the step remains as it is in the common liquid chamber 42. The step may cause stagnation of the recording liquid, or defective charging. In order to avoid this, the damper layer 18 is also formed along the vertical surface within the common liquid chamber 42, so that the damper layer 18 covers the step. By forming the damper layer 18 within the common liquid chamber 42 to cover the step, ease of charging the common liquid chamber 42 with the recording liquid can be improved.

When an elastomer is used as a material of the damper layer 18, and PPS is used as a material of the backing plate 17, in general, adhesiveness between these materials is weak. However, by forming the damper layer 18 along the vertical surface within the common liquid chamber 42, similar to this example, an adhesion area between the damper layer 18 and the backing plate 17 can be enlarged. Accordingly, adhesive strength can be increased.

Thus, the durability of the droplet discharge head can be improved. Further, the yield rate of the droplet discharge head can be increased.

Another Example

Hereinafter, there is explained another example of the droplet discharge head according to the embodiment.

Figure 14A:
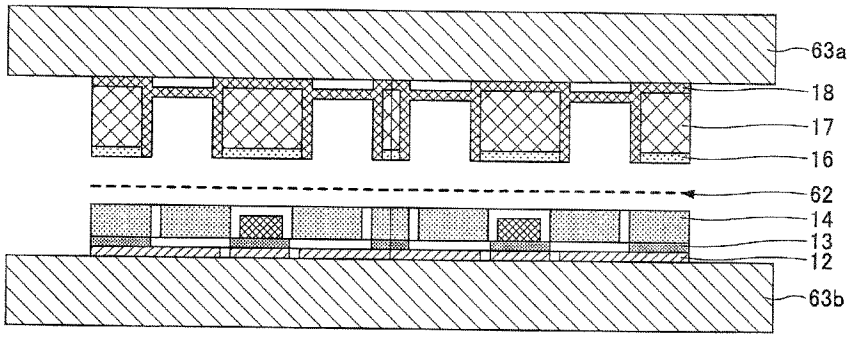
FIGS. 14A and 14B are schematic lateral cross-sectional views of the droplet discharge head according to another example, wherein the droplet discharge head is being assembled.
Figure 14B:
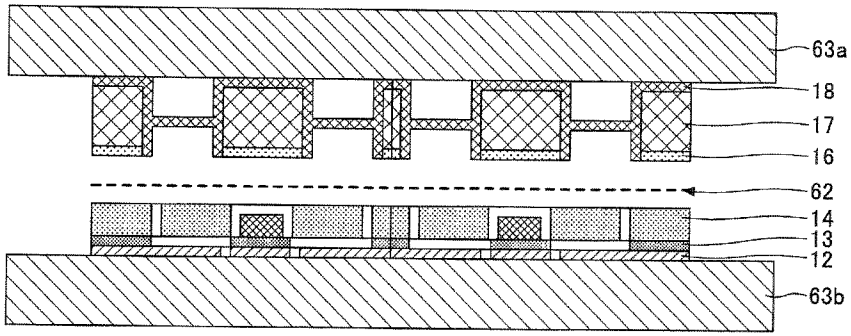

The droplet discharge head according to this example has a configuration which is shown in FIG. 14. The external appearance of the droplet discharge head according to this example is similar to that of the droplet discharge head according to the third one of the above-described examples. In the droplet discharge head according to this example, the damper layer 18 is formed along the entire vertical surface within the common liquid chamber 42. Namely, the damper layer 18 is also formed at the portion of the backing plate 16. Since other points of the droplet discharge head according to this example are the same as those of the droplet discharge head according to any one of the above-described examples, explanations of the other points are omitted.

Figure 15A:
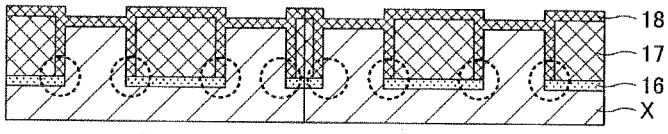
FIGS. 15A and 15B are diagrams illustrating a damper layer forming process of the droplet discharge heads according to the above two examples.
Figure 15B:
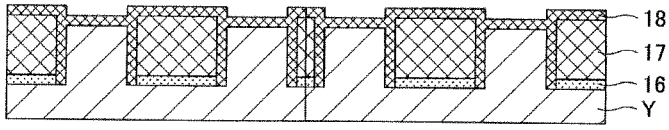

There is explained the difference between the droplet discharge head according to this example and that of the third one of the above-described examples by referring to FIGS. 15A and 15B.

FIG. 15A shows the forming process of the damper layer 18 according to the third one of the above-described examples. In FIG. 15A, the element denoted by "X" is a metal mold for forming the damper layer 18. As shown in FIG. 15A, the clearance between the metal mold X and the backing plate 16 may not be eliminated at the portions enclosed in the corresponding dotted line circles. Namely, in some cases, slight spacing may be generated between the metal mold X and the backing plate 16. In such cases, a material of the damper layer 18, such as an elastomer, may flow into the spacing between the metal mold X and the backing plate 16. Consequently, it is possible that the damper layer 18 is molded to have an unintentional shape, depending on the size of the spacing.

For the case of the droplet discharge head according to this example, as shown in FIG. 15B, spacing is provided between the backing plate 16 and a metal mold Y. The material of the damper layer 18, such as the elastomer, is proactively flown into the spacing between the backing plate 16 and the metal mold Y. The configuration according to this example can demonstrate an effect, which is the same as that of the third one of the above-described examples. Additionally, the shape of the common liquid chamber substrate can be stably formed.

Another Example

Hereinafter, there is explained another example of the droplet discharge head according to the embodiment.

Figure 16A:
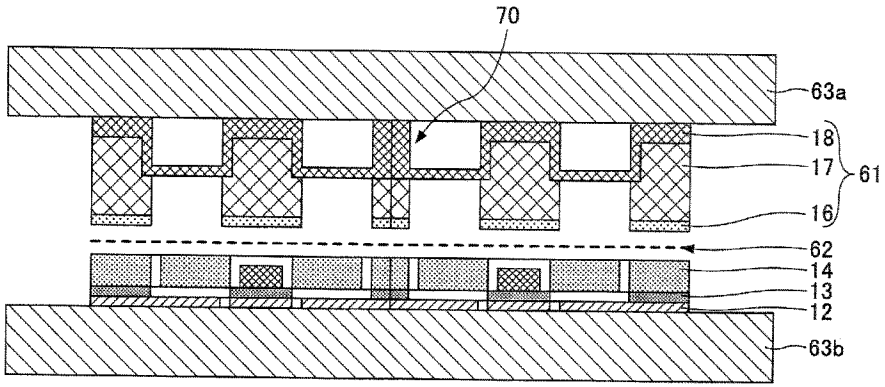
FIGS. 16A and 16B are schematic lateral cross-sectional views of the droplet discharge head according to another example, wherein the droplet discharge head is being assembled.
Figure 16B:
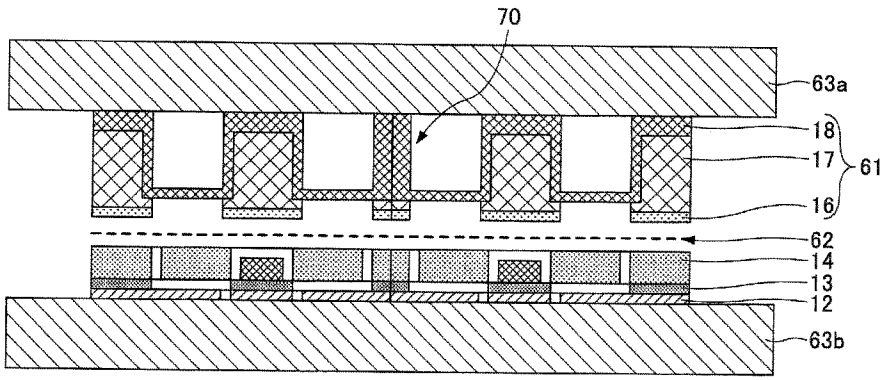

FIGS. 16A and 16B shows a configuration of the droplet discharge head according to this example. The droplet discharge head according to this example is different from the first one of the above-described examples of the droplet discharge head in a point that the damper layer 18 is formed not only in the top surface of the common liquid chamber 42, but also in a portion of the wall surface of the common liquid chamber 42 (the wall surface is substantially perpendicular to the top surface). This point is explained. Since other points of the droplet discharge head according to this example are the same as those of the droplet discharge head according to the first one of the above-described examples of the droplet discharge head, explanations of the other points are omitted.

External appearance of the droplet discharge head according to this example is similar to that of the droplet discharge head according to the second one of the above-described examples. The schematic longitudinal cross-sectional view of the droplet discharge head according to this example is similar to that of FIG. 10. FIG. 16A corresponds to the cross-sectional view of the droplet discharge head at the B-B line in FIG. 10. FIG. 16B corresponds to the cross-sectional view of the droplet discharge head at the C-C line in FIG. 10.

The droplet discharge head according to this example is different from the droplet discharge head according to the second one of the above-described examples in a point that a concave portion is formed in a portion of the vertical wall surface within the common liquid chamber 42, and a portion of the damper layer 18 is formed in the concave portion.

As shown in FIG. 16, the droplet discharge head includes a center rib 70, which is disposed at center in the lateral direction. A portion of the center rib 70 at the side of the top surface (upper side) is formed of the flexible material, which is the same as the material of the damper layer 18. In this example, the width of the center rib 70 is small (e.g., approximately 0.5 mm), so that capacity of the common liquid chamber 42 can be secured, and the droplet discharge head can be downsized. For example, when the backing plate 17 is formed of a resin, such as PPS, it is difficult to inject two types of resins, which are the resin of the backing plate 17 and the resin of the damper layer 18, into the portion of the center rib 70, and mold the center rib 70 with these two types of the resins.

Similar to the droplet discharge head according to the second one of the above-described examples, by lowering the top surface portion of the common liquid chamber by one step, the damper layer 18 can be prevented from contacting the jigs 63*a* and 63*b*, during assembling of the droplet discharge head. In this manner, during manufacturing or assembling of the droplet discharge head, the damper layer 18 can be pressed, while preventing the damper layer 18 (which is a thin film portion of the common liquid chamber 42, namely, which is a flexible member) from being damaged.

When the elastomer is used for the damper layer 18 and PPS is used for the backing plate 17, in general, adhesiveness of these materials with respect to each other is weak. In this example, since the concave portion is formed in the backing plate 17, an adhesion area in the vertical wall surface is added. Consequently, adhesive strength is increased. Thus, the durability of the droplet discharge head can be improved, and the yield rate of the droplet discharge head can be increased.

Further, since the portion of the damper layer 18 is formed in the concave portion of the backing plate 11, the width of the droplet discharge head in the lateral direction (the width direction in FIGS. 16A and 16B) can be reduced, while securing the capacity of the common liquid chamber 42.

Another Example

Hereinafter, there is explained another example of the droplet discharge head according to the embodiment.

The droplet discharge head according to this example is different from the first one of the above-described examples of the droplet discharge head in a point that the damper layer 18 is formed not only in the top surface of the common liquid chamber 42, but also in a portion of the wall surface of the common liquid chamber 42 (the wall surface is substantially perpendicular to the top surface). This point is explained. Since other points of the droplet discharge head according to this example are the same as these of the droplet discharge head according to the first one of the above-described examples of the droplet discharge head, explanations of the other points are omitted.

In the droplet discharge head according to this example, at least a portion of the wall surface of the common liquid chamber 42 (the wall surface is substantially perpendicular to the top surface of the common liquid chamber 42) is formed by laminating a flexible member and a rigid member. Here, the rigidity of the rigid member is higher than that of the flexible member.

At the narrowed portion of the common liquid chamber 42, the vertical wall surface includes a continuously varying portion and a discontinuously varying portion. Here, the continuously varying portion is such that, as the common liquid chamber 42 is narrowed, the percentage of the flexible member in the vertical wall in the height direction is continuously increased. The discontinuously varying portion is disposed adjacent to the continuously varying portion. In the discontinuously varying portion, the percentage of the rigid member in the vertical wall in the height direction is greater than that of the neighboring continuously varying portion.

Hereinafter, there is explained the droplet discharge head according to this example by referring to FIGS. 17, 18A, and 18B.

Figure 17:
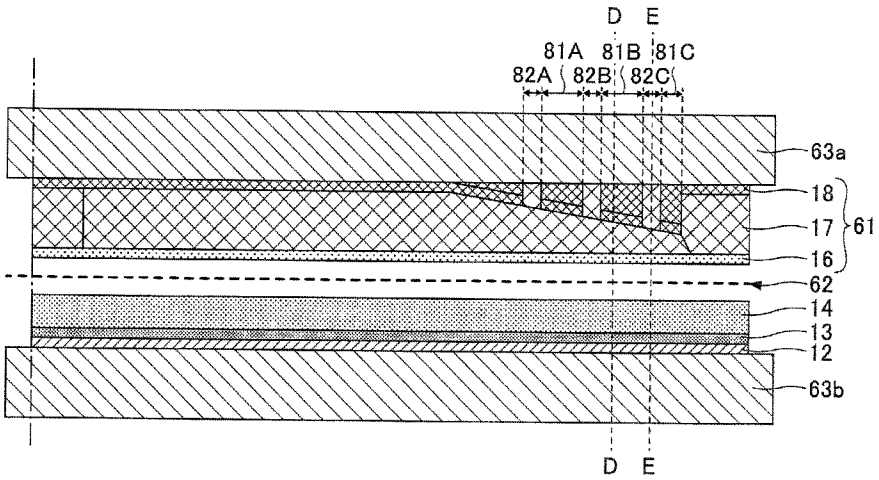
FIG. 17 is a schematic longitudinal view of the droplet discharge head according to another example, wherein the droplet discharge head is being assembled.

FIG. 17 shows a schematic cross-sectional view in the longitudinal direction of the droplet discharge head (schematic longitudinal cross-sectional view of the droplet discharge head). FIG. 17 shows a state where the sub-frame 14, the individual liquid chamber substrate (actuator plate) 13, and the nozzle substrate 12 are laminated and adhesively bonded to the common liquid chamber substrate 61 on the bonding interface 62. Here, the common liquid chamber substrate 61 includes the backing plate 16, the backing plate 17, and the damper layer 18.

Figure 18A:
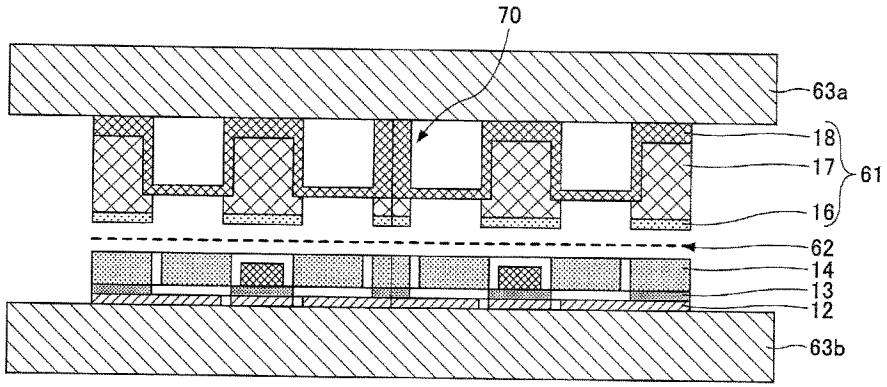
FIGS. 18A and 18B are schematic lateral cross-sectional views of the droplet discharge head according to the other example, wherein the droplet discharge head is being assembled.

FIG. 18A snows the cross-section of the droplet discharge head at the D-D line in FIG. 17. FIG. 18B shows the cross-section of the droplet discharge head at the E-E line in FIG. 17. Here, FIG. 17 corresponds to the cross-sectional view of the droplet discharge head at the portion of the center rib 70 in FIGS. 18A and 18B.

In the droplet discharge head according to this example, at least a portion of the vertical wall of the common liquid chamber 42 (the vertical wall is substantially perpendicular to the top surface of the common liquid chamber 42) is formed by laminating a flexible member and a rigid member. Here, the rigidity of the rigid member is higher than that of the flexible member. For the case of the droplet discharge head which is shown in FIGS. 17, 18A, and 18B, the backing plate 16 and the backing plate 17 correspond to the rigid member, and the damper layer 18 corresponds to the flexible member. In this example, the rigid member is formed by laminating the backing member 16 and the backing member 17. However, the rigid member is not limited to this. For example, the rigid member may be formed of a single member. Alternatively, the rigid member may be formed of three or more members. This also applies to the flexible member.

At the narrowed portion of the common liquid chamber 42, the vertical wall surface includes the continuously varying portion and the discontinuously varying portion. Here, the continuously varying portion is such that, as the common liquid chamber 42 is narrowed, the percentage of the flexible member in the vertical wall in the height direction is continuously increased. The discontinuously varying portion is disposed adjacent to the continuously varying portion. In the discontinuously varying portion, the percentage of the rigid member in the vertical wall in the height direction is greater than that of the neighboring continuously varying portion.

For the case of FIG. 17, the narrowed portion of the common liquid chamber 42 is the edge portion of the common liquid chamber 42. Namely, the narrowed portion of the common liquid chamber 42 is the right portion in FIG. 17, which is the tip portion in the direction in which the recording liquid flows. At the right portion, the common liquid chamber 42 is narrowed in the height direction (the vertical direction), namely, in the direction in which the substrates are laminated. FIG. 17 shows only a half portion of the common liquid chamber 42 in the longitudinal direction. The common liquid chamber 42 as a whole may include two narrowed portions.

As described above, in the droplet discharge head according to this example, the common liquid chamber 42 includes the continuously varying portion and the discontinuously varying portion.

In FIG. 17, the continuously varying portion corresponds to portions indicated as 81A, 81B, and 81C. In the continuously varying portion, the percentage of the flexible member in the vertical wall in the height direction is continuously increased along the direction in which the recording liquid flows.

In FIG. 17, the discontinuously varying portion corresponds to portions indicated as 82A, 82B, and 82C. The discontinuously varying portion is arranged in the vicinity of the continuously varying portion. In the discontinuously varying portion, the percentage of the rigid member in the vertical wall in the height direction is greater than that of the neighboring continuously varying portion.

Figure 18B:
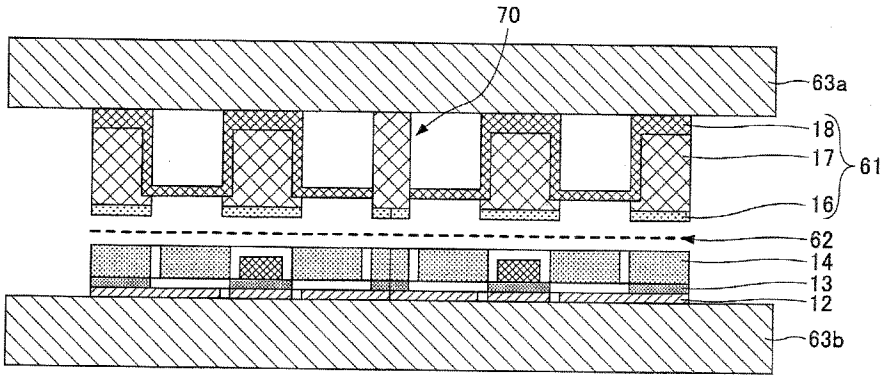

As shown in FIGS. 18A and 18B, the vertical wall has a structure in which the flexible member and the rigid member are laminated. When the common liquid chamber substrate 61 and other substrates are bonded, the pressure from the jig 63*a* is transmitted to the components through the flexible member, whose rigidity is low.

When the vertical wall has such a structure, during bonding the common liquid chamber substrate 61 and other substrates, it is possible that, in a portion having a high percentage of the flexible member, such as the portion of the center rib 0 which is included in the continuously varying portion as shown in FIG. 18A, the flexible member is deformed, and the necessary pressure for bonding is not applied from the jig 63*a*.

When the discontinuously varying portion is included, in which the percentage of the rigid member is greater than that of the neighboring continuously varying portion, such as the portion of the center rib 70 in FIG. 18B, the percentage of the flexible member, which absorbs the pressure and tends to be deformed, is small in the discontinuously varying portion. Accordingly, when the pressure is applied to the discontinuously varying portion by the jigs 63*a* and 63*b*, the discontinuously varying portion tends to transmit the pressure from the jigs 63*a* and 63*b* to the bonding interface 62, compared to the neighboring continuously varying portion.

By arranging the discontinuously varying portion in the vicinity of the continuously varying portion, even if the pressure from the jigs 63*a* and 63*b* may not be sufficiently transmitted in the continuously varying portion, the pressure can be sufficiently transmitted in the continuously varying portion. In this manner, the common liquid chamber substrate 61 can be bonded to the other substrates more securely.

Further, by including the continuously varying portion and the discontinuously varying portion, a contact area between the flexible member and the rigid member can be enlarged. Thus, sufficient adhesion can be achieved between them.

As shown in FIG. 17, a plurality of continuously varying portions and a plurality of discontinuously varying portions may be formed. However, one narrowed portion may include only one continuously varying portion and only one discontinuously varying portion. Any number of the continuously varying portions and the discontinuously varying portions may be included, depending on the size of the droplet discharge head and the required adhesive strength. Similarly, the positions and sizes of the continuously varying portions and the discontinuously varying portions may be suitably selected depending on the size of the droplet discharge head and the required adhesive strength.

The discontinuously varying portion may be formed as a protrusion of the rigid member. The discontinuously varying portion may include a set of discontinuously varying portions. Here, each of the discontinuously varying portions of the set may include only one protrusion of the rigid member. Alternatively, each of the discontinuously varying portions of the set may include a plurality of protrusions of the rigid member. Namely, the discontinuously varying portion preferably includes one or more protrusions of the rigid member. The shape and size of the protrusion may be suitably selected, depending on the required adhesive strength, for example.

Further, it is preferable that, in the lateral direction of the vertical wall, the width of the protrusion be less than the width of the vertical wall.

Figure 19A:
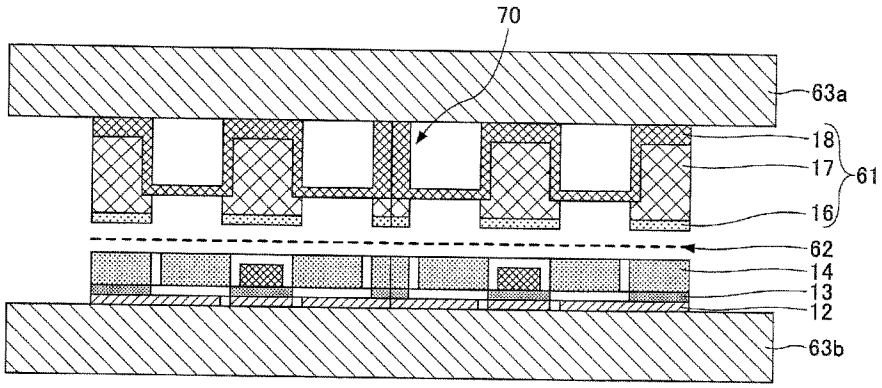
FIGS. 19A and 19B are schematic lateral cross-sectional views of the droplet discharge head according to the other example, wherein the droplet discharge head has another configuration and is being assembled.
Figure 19B:
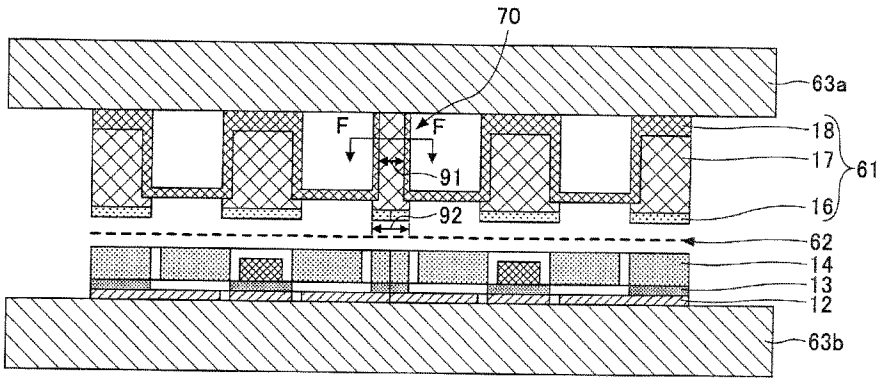

FIGS. 19A and 19B show a configuration example of the droplet discharge head having such a structure. FIG. 19A shows the cross-section of the droplet discharge head of FIG. 17 at the D-D line in FIG. 17. FIG. 19B shows the cross-section of the droplet discharge head of FIG. 17 at the E-E line in FIG. 17. FIG. 17 corresponds to the cross-section of the droplet discharge head of FIGS. 19A and 19B at the center rib 70, which is disposed at center in the lateral direction in FIGS. 19A and 19B.

As shown in FIG. 19B, the width 91 of the protrusion in the center rib 70 is slightly smaller than the width 92 of the vertical wall (in the lateral direction). The flexible member (the damper layer 18) is arranged like a thin film in the vicinity of the protrusion. In order to form such a structure, namely, the structure in which the flexible member is arranged like a thin film in the vicinity of the protrusion, it may be required to inject a resin into small spacing in the vicinity of the protrusion. However, as described in the filth one of the above-described examples, it may be difficult to inject the resin into the small spacing and to mold the damper layer 18. Especially, it is possible that the damper layer 18 is defectively molded. However, in this case, the defective molding is not a problem. The width for molding the vertical wall, which is formed of the backing plate 17, is already secured. Further, the damper layer 18 which is formed in the vicinity of the protrusion has a shape for improving adhesiveness between the two members. Thus, even if the thickness of the damper layer 18 in the vicinity of the protrusion is uneven, structurally, there is no problem.

The shape of the protrusion is not particularly limited. However, the protrusion may have a cylindrical shape.

Figure 20:
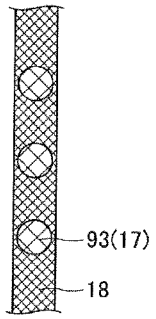
FIG. 20 is a cross-sectional view at a F-F line in FIG. 19.

There is explained a configuration example of the protrusion, in which the protrusion has a cylindrical shape, by referring to FIG. 20.

FIG. 20 shows a cross section of the center rib 70 at the F-F line in FIG. 19.

When the protrusion 93 (the backing plate 17) has the cylindrical shape, the area, in the vicinity of which the damper layer 18 (the flexible member) is formed like a thin film, can be reduced. Thus, the above-described defective molding can be prevented from occurring. Further, since the adhesion area between the backing plate 17 and the damper layer 19 can be enlarged, the adhesive strength between them can be increased.

Further, as shown in FIG. 18B, the flexible member may not be arranged on the top surface of the protrusion. This configuration is preferable in a point that the pressure from the jig 63*a* can be directly applied. However, for a case where there is unevenness on the surface of the jig 63*a*, or for a case where there is unevenness on the top surface of the protrusion, it is possible that the precision during bonding is insufficient due to the effect of the unevenness, or it is possible that the pressure from the jig 63*a* is not applied in the intended direction. In order to avoid the effect of the unevenness of the surfaces, the flexible member may be arranged on the top surface of the protrusion.

Figure 21A:
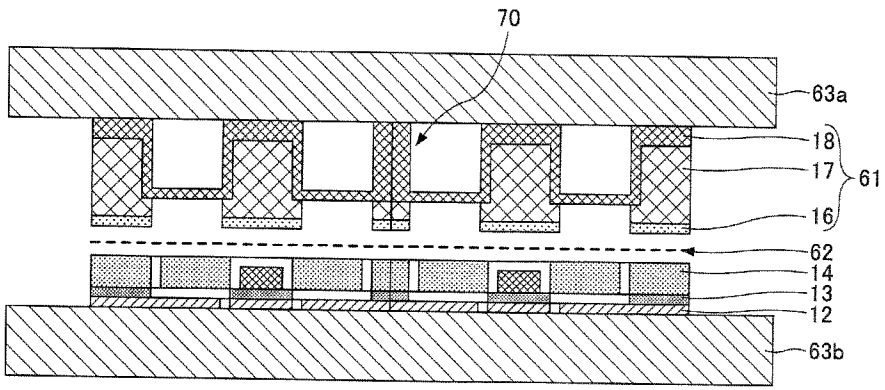
FIGS. 21A and 21B are lateral cross-sectional views of the droplet discharge head according to the other example, wherein the droplet discharge head has the other configuration and is being assembled.
Figure 21B:
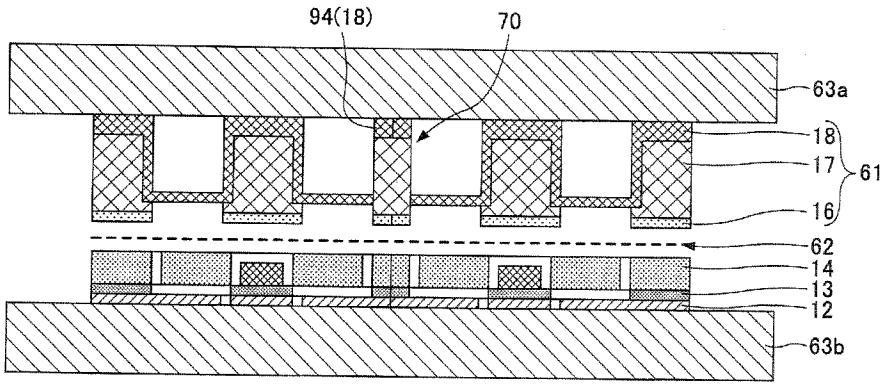

Specifically, as shown in FIG. 21B, in the structure shown in FIG. 18B, a flexible member 94 (18) may be disposed on the top surface portion of the center rib 70.

With such a configuration, flatness of the jig 63 and the flatness of the component which is contacted by the jig 63*a* may be absorbed. In this case, in order to securely transmit the pressure from the jig 63*a*, it is preferable that the thickness of the damper layer disposed on the top surface be several hundred microns.

In the above-explained example, the narrowed portion of the center rib 70 includes the continuously varying portion and the discontinuously varying portion. However, a portion which includes the continuously varying portion and the discontinuously varying portion is not limited to the center rib 70. A vertical wall which is included in another common liquid chamber 42 may have a similar structure.

The droplet discharge head according to this example is explained above. In the droplet discharge head according to this example, it is preferable that at least a portion of the members, such as the flexible member and the rigid member, included in the walls of the common liquid chamber 42 be integrally molded.

With such a configuration, many components can be joined without introducing an adhesion layer. Thus, production requirements can be reduced and cost reduction can be achieved.

Further, it is preferable that, for example, portions which directly contact the flexible member be integrally molded. For example, the common liquid chamber (ink reservoir) 42 may be formed by two-color molding the flexible member (damper layer 18) with respect to the integrally-molded product in which the backing plate 16, the backing plate 17, and the housing 11 are integrally molded.

Additionally, it is preferable that the above-described flexible member (damper layer 18) be formed by injection molding of an elastomer.

In the above-described examples, the explanations are mainly given with respect to the configuration of the narrowed portion of the droplet discharge head. However, the configuration of the narrowed portion according to the embodiment may be applied to a droplet discharge head having another configuration. Especially, as explained in the fifth one of the above-explained examples, the configuration of the narrowed portion according to the embodiment can be preferably applied to a case where a portion is included such that the percentage of the flexible member in the vertical wall in the height direction is large.

Further Example

In this example, there is explained an image forming apparatus which includes the droplet discharge head according to any one of the above-described examples.

Figure 22:
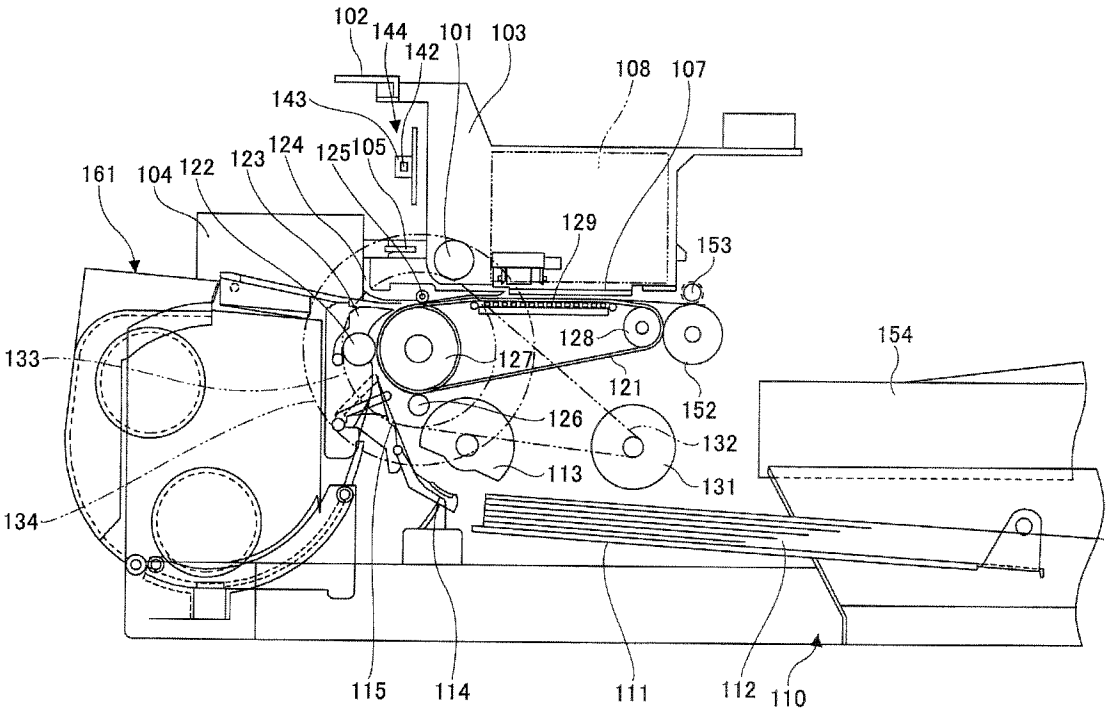
FIG. 22 is a side view of an image forming apparatus according to an example.
Figure 23:
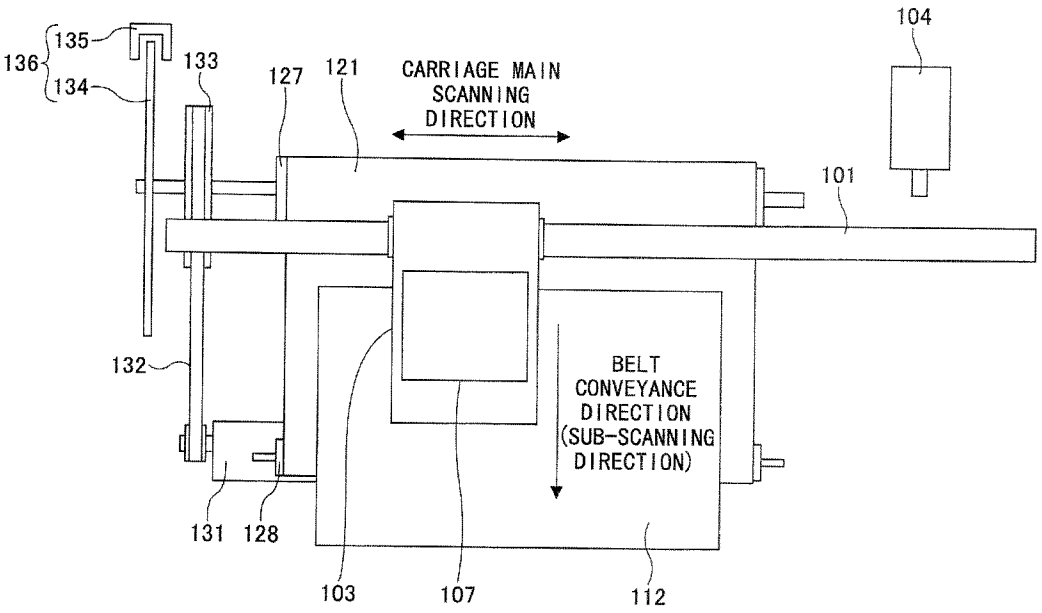
FIG. 23 is a plane view of major portions of the image forming apparatus according to the example.

Hereinafter, there is explained a configuration of the image forming apparatus according to this example by referring to FIGS. 22 and 23. FIG. 22 is a side view illustrating the overall structure of the image forming apparatus. FIG. 23 is a diagram illustrating major portions of the image forming apparatus.

In the image forming apparatus, a carriage 103 is supported by a guide rod 101 and a guide rail 102, so that the carriage 103 can be slid in a main scanning direction. The guide rod 101 and the guide 102 are horizontally supported by a left side plate (not shown) and a right side plate (not shown). The carriage 103 is moved by a main scanning motor 104 through a timing belt 105 in directions indicated by the arrows in FIG. 23 (main scanning direction) while scanning.

A droplet discharge head (inkjet head) 107 for discharging yellow (Y) ink, cyan (C) ink, magenta (M) ink, and black (Bk) ink is attached to the carriage 103, while a plurality of ink discharge ports are arranged in a direction which intersects the main scanning direction, and an ink droplet discharge direction is directed downward. Here, as the droplet discharge head 107, the droplet discharge head according to any one of the above-described examples is utilized.

Further, the carriage 103 includes sub-tanks 108 for supplying the corresponding colors of ink to the droplet discharge head 107. The ink in each of the colors is supplied from a main tank (ink cartridge) to the corresponding sub-tank 108 through an ink supply tube (not shown).

In this example, the droplet discharge device includes the sub-tanks 108 and the head 107. However, the head 107 may be the droplet discharge head according to any one of the above-described examples, and the sub-tanks 108 may be separately disposed. Alternatively, the ink cartridges may be included in the head 107, without using the sub-tanks 108.

As a paper feed unit for feeding paper sheets 112 which are stacked on a paper stacking unit (platen) 111 (e.g., a paper feeding cassette 110), the image forming apparatus includes a half-moon roller (paper feed roller) 113 and a separation pad 114. The paper feed roller 113 separates the paper sheets 112 stacked on the paper stacking units 111, and feeds the paper sheets 112 one-by-one. The separation pad 114 faces the paper feed roller 113. The separation pad 114 is formed of a material having a large coefficient of friction. The separation pad 114 is pressed toward the paper feed roller 113.

Further, the image forming apparatus includes, as a conveyance unit for conveying the paper sheet 112 which is fed from the paper feed unit at a portion below the recording head 107, a conveyance belt 121 for electrostatically attracting the paper sheet 112; a counter roller 122 for nipping the paper sheet 112 (which is sent from the paper feeding unit through a guide 115) with the conveyance belt 121, and for conveying the paper sheet 112; a conveyance guide 123 which changes the conveyance direction of the paper sheet 112 by approximately 90 degrees from the upward direction (substantially vertical direction), and causes the paper sheet to follow the conveyance belt 121; and a tip pressing roller 125 which is pressed toward the conveyance belt 121 by a pressing member 124. The image forming apparatus also includes a charging roller 126 for charging the surface of the conveyance belt 121.

The conveyance belt 121 is an endless belt. The conveyance belt 121 is wound around a conveyance roller 127 and a tension roller 128. The conveyance belt 121 is caused to circulate in the belt conveyance direction (sub-scanning direction) by the rotation of the conveyance roller 127. Here the conveyance roller 127 is rotated by a sub-scanning motor 131 through a timing belt 132 and a timing roller 133. A guide member 129 is disposed on a reverse side of the conveyance belt 121. The position of the guide member 129 corresponds to an area on which an image is formed by the head 107.

As shown in FIG. 23, a slit disk 134 is attached to an axis of the conveyance roller 127. A sensor 135 for detecting a slit of the slit disk 134 is disposed. The slit disk 134 and the sensor 135 form an encoder 136.

The charging roller 126 contacts a surface layer of the conveyance belt 121. The charging roller 126 is arranged to be rotated by the rotation of the conveyance belt 121. For example, a pressing force of 2.5 N is applied to end portions of an axis of the charging roller 126.

As shown in FIG. 22, in front of the carriage 103, an encoder scale 142 is disposed, in which slits are formed. Further, in front of the carriage 103, an encoder sensor 143, which is formed of a transmissive photosensor, is disposed, so as to detect a slit of the encoder scale 142. The encoder scale 142 and the encoder sensor 143 form an encoder 144 for detecting a position of the carriage 103 (a position relative to a home position) in the main scanning direction.

Further, the image forming apparatus includes, as a paper discharging unit for discharging the paper sheet 112 on which an image is recorded by the head 107, a separation unit for separating the paper sheet 112 from the conveyance belt 121; paper discharge rollers 152 and 153; and a paper discharge tray 154 for stocking the discharged paper sheets 112.

Further, at a rear side of the image forming apparatus, a double-sided paper feed unit 161 is detachably attached. The double-sided paper feed unit 161 takes in the paper sheet 112 which is returned by the reverse rotation of the conveyance belt 121, and the double-sided paper feed unit 161 feeds the paper sheet 112 again to the nip between the counter roller 122 and the conveyance belt 121.

In the image forming apparatus having such a configuration, the paper sheets 112 are separated and fed one-by-one from the paper feed unit; the paper sheet 112, which is fed substantially vertically upward, is guided by the guide 115, and the paper sheet 112 is nipped between the conveyance belt 121 and the counter roller 122, and conveyed; and the tip of the paper sheet 112 is guided by the conveyance guide 123, and the tip of the paper sheet 112 is pressed toward the conveyance belt 121 by the tip pressing roller 125, and thereby the conveyance direction of the paper sheet 112 is changed by substantially 90 degrees.

At this time, a control circuit (not shown) causes voltage to be applied from a high voltage power supply to the charging roller 126 such that a plus output and a minus output are alternately repeated. Namely, an alternating voltage is applied to the charging roller. Then, the conveyance belt 121 is charged to have an alternating charging voltage pattern. Namely, the conveyance belt 121 is charged in the sub-scanning direction (rotating direction) such that a belt shaped positively charged pattern having a predetermined width and a belt shaped negatively charged pattern having the predetermined width are alternately formed. When the paper sheet 112 is fed onto the conveyance belt 121, which is alternately charged positively and negatively, the paper sheet 112 is attracted by the conveyance belt 121 by the electrostatic force. Subsequently, the paper sheet 112 is conveyed in the sub-scanning direction by the rotational movement of the conveyance belt 121.

Ink droplets are discharged onto the stopped paper sheet 112 by driving the head 107 in accordance with an image signal, while moving the carriage 103. In this manner, one line can be recorded on the paper sheet 112. After moving the paper sheet 112 by a predetermined distance, the next line is recorded on the paper sheet 112. When the image forming apparatus receives a recording termination signal or a signal indicating that a rear end of the paper sheet 112 reaches the recording area, the image forming apparatus terminates the recording operation, and the image forming apparatus discharges the paper sheet 112 onto the paper discharge tray 154.

For the case of the duplex printing, at a time of completing the recording on a first side (the side on which an image is printed first), the recorded paper sheet 112 is fed into the double-sided paper feed unit 161, by rotating the conveyance belt 121 in the reverse direction. Then, the paper sheet 112 is inverted (the paper sheet 112 is in a state in which the rear side is the printed side), and the paper sheet 112 is fed again to the nip between the counter roller 122 and the conveyance belt 121. Subsequently, the paper sheet 112 is conveyed onto the conveyance belt 121 by performing the timing control, similar to the above-described case, and an image is recorded on the rear side of the paper sheet. Then, the paper sheet 112 is discharged onto the paper discharge tray 154.

The image forming apparatus according to the embodiment of the present invention may be applied to a printer, a facsimile machine, a copier, and a combined machine thereof. Further, the droplet discharge head according to the embodiment of the present invention may be applied to a droplet discharge head or a droplet discharge device that discharges a liquid other than the ink, such as a DNA sample, a resist solution, or a pattern material. Furthermore, the droplet discharge head according to the embodiment may be applied to an image forming apparatus including the above-described droplet discharge head or droplet discharge device.

The present invention is not limited to the specifically disclosed embodiment, and variations and modifications may be made without departing from the scope of the present invention.

The present application is based on and claims the benefit of priority of Japanese Priority Applications No. 2012-204877 filed on Sep. 18, 2012, and No. 2013-022038 filed on Feb. 7, 2013, the entire contents of which are hereby incorporated herein by reference.

What is claimed is:

1. A droplet discharge head comprising:

a nozzle substrate including a nozzle configured to discharge liquid droplets;

an individual liquid chamber substrate in which an individual liquid chamber is formed, wherein the individual liquid chamber is in communication with the nozzle;

a common liquid chamber substrate, a common liquid chamber having been formed as a reservoir in said common liquid chamber substrate, the nozzle substrate being disposed to one side of the common liquid chamber substrate; and a flexible member disposed at an opposite side of the common liquid chamber substrate which is opposite to said one side of the common liquid chamber substrate to which the nozzle substrate is disposed, wherein the common liquid chamber is in communication with the individual liquid chamber, wherein the nozzle substrate, the individual liquid chamber substrate, and the common liquid chamber substrate are laminated, wherein a part of the flexible member forms a damper layer disposed at a top surface of the common liquid chamber on said opposite side of the common liquid chamber substrate which is opposite to said one side of which the nozzle substrate is disposed, wherein the common liquid chamber has a shape such that at least one portion of the common liquid chamber is narrowed in a direction in which the nozzle substrate, the individual liquid chamber substrate, and the common liquid chamber substrate are laminated, and wherein a total height, in a direction of the lamination, constituted by a height of a wall that forms an inner wall surface of the reservoir constituting the common liquid chamber substrate and a height of the flexible member disposed above the wall is constant along a longitudinal direction of the common liquid chamber.

2. The droplet discharge head according to claim 1, wherein, in the wall of the common liquid chamber, at least a part of a first member which forms the flexible portion and a second member which forms a portion other than the flexible portion is integrally molded.

3. The droplet discharge head according to claim 1, wherein the flexible portion is molded by injection molding of an elastomer.

4. The droplet discharge head according to claim 1, wherein at least one portion of the wall of the common liquid chamber is flexible.

5. A droplet discharge head comprising:

a nozzle substrate including a nozzle configured to discharge liquid droplets;

an individual liquid chamber substrate in which an individual liquid chamber is formed, wherein the individual liquid chamber is in communication with the nozzle; and a common liquid chamber substrate in which a common liquid chamber is formed, wherein the common liquid chamber is in communication with the individual liquid chamber, wherein the nozzle substrate, the individual liquid chamber substrate, and the common liquid chamber substrate are laminated, wherein at least a portion, which is a flexible portion, of a top surface of the common liquid chamber is flexible, wherein the top surface of the common liquid chamber is disposed at a side which is opposite to another side at which the nozzle plate is disposed, wherein the common liquid chamber has a shape such that at least one portion of the common liquid chamber is narrowed in a direction in which the nozzle substrate, the individual liquid chamber substrate, and the common liquid chamber substrate are laminated, wherein a height of a wall of the common liquid chamber in the direction in which the nozzle substrate, the individual liquid chamber substrate, and the common liquid chamber substrate are laminated is constant, wherein the wall is substantially perpendicular to the top surface, wherein at least one portion of a vertical wall being the wall perpendicular to the top surface of the common liquid chamber is formed by laminating a flexible member and a rigid member, wherein first rigidity of the rigid member is greater than second rigidity of the flexible member, wherein, in a narrowed portion of the common liquid chamber, the vertical wall includes a continuously varying portion such that, as the common liquid chamber is narrowed, a first percentage of the flexible member in a height direction of the vertical wall continuously increases; and a discontinuously varying portion which is disposed adjacent to the continuously varying portion, and wherein, in the discontinuously varying portion, a second percentage of the rigid member in the height direction of the vertical wall is greater than a third percentage of the rigid member in the height direction of the vertical wall in the continuously varying portion.

6. The droplet discharge head according to claim 5, wherein, in the discontinuously varying portion, the rigid member includes one or more protrusions.

7. The droplet discharge head according to claim 6, wherein each of the one or more protrusions is such that, in a short-length direction of the vertical wall, a first width of the protrusion is less than a second width of the vertical wall.

8. The droplet discharge head according to claim 6, wherein each of the one or more protrusions has a cylindrical shape.

9. The droplet discharge head according to claim 6, wherein the flexible member is disposed on a top surface of the one or more protrusions.

10. The droplet discharge head according to claim 5, wherein the flexible member is molded by injection molding of an elastomer.

11. An image forming apparatus including a droplet discharge head, wherein the droplet discharge head comprises:

a nozzle substrate including a nozzle configured to discharge liquid droplets;

an individual liquid chamber substrate in which an individual liquid chamber is formed, wherein the individual liquid chamber is in communication with the nozzle;

a common liquid chamber substrate, a common liquid chamber having been formed as a reservoir in said common liquid chamber substrate, the nozzle substrate being disposed to one side of the common liquid chamber substrate; and a flexible member disposed at an opposite side of the common liquid chamber substrate which is opposite to said one side of the common liquid chamber substrate to which the nozzle substrate is disposed, wherein the common liquid chamber is in communication with the individual liquid chamber, wherein the nozzle substrate, the individual liquid chamber substrate, and the common liquid chamber substrate are laminated, wherein a part of the flexible member forms a damper layer disposed at a top surface of the common liquid chamber on said opposite side of the common liquid chamber substrate which is opposite to said one side of which the nozzle substrate is disposed, wherein the common liquid chamber has a shape such that at least one portion of the common liquid chamber is narrowed in a lamination direction in which the nozzle substrate, the individual liquid chamber substrate, and the common liquid chamber substrate are laminated, and wherein a total height, in a direction of the lamination, constituted by a height of a wall that forms an inner wall surface of the reservoir constituting the common liquid chamber substrate and a height of the flexible member disposed above the wall is constant along a longitudinal direction of the common liquid chamber.

12. The droplet discharge head according to claim 1, wherein, in the narrowed portion of the common liquid chamber, a height from a surface of the common liquid chamber facing the individual liquid chamber substrate to the damper layer disposed at the top surface of the common liquid chamber is smaller than the height of the wall that forms the inner wall surface of the reservoir constituting the common liquid chamber, in the lamination direction.

13. The image forming apparatus according to claim 11, wherein, in the narrowed portion of the common liquid chamber, a height from a surface of the common liquid chamber facing the individual liquid chamber substrate to the damper layer disposed at the top surface of the common liquid chamber is smaller than the height of the wall that forms the inner wall surface of the reservoir constituting the common liquid chamber, in the lamination direction.

* * * * *